US007066264B2

(12) United States Patent
Bissonnette et al.

(10) Patent No.: US 7,066,264 B2
(45) Date of Patent: Jun. 27, 2006

(54) METHOD AND APPARATUS FOR TREATING A SUBTERRANEAN FORMATION

(75) Inventors: H. Steven Bissonnette, Sugar Land, TX (US); L. Michael McKee, Friendswood, TX (US); Ezio Toffanin, Brussels (BE)

(73) Assignee: Schlumberger Technology Corp., Sugar Land, TX (US)

( * ) Notice: Subject to any disclaimer, the term of this patent is extended or adjusted under 35 U.S.C. 154(b) by 331 days.

(21) Appl. No.: 10/754,201

(22) Filed: Jan. 9, 2004

(65) Prior Publication Data

US 2004/0238173 A1 Dec. 2, 2004

Related U.S. Application Data

(60) Provisional application No. 60/439,640, filed on Jan. 13, 2003.

(51) Int. Cl.
*E21E 43/04* (2006.01)
*E21B 43/14* (2006.01)
*E21B 43/26* (2006.01)

(52) U.S. Cl. ..... 166/305.1; 166/51; 166/147; 166/177.5; 166/191; 166/237; 166/278; 166/313; 166/381

(58) Field of Classification Search ..... 166/313, 166/381, 305.1, 382, 191, 147, 177.5, 237, 166/240, 51, 278
See application file for complete search history.

(56) References Cited

U.S. PATENT DOCUMENTS 4,105,069 A * 8/1978 Baker ..... 166/51
4,270,608 A * 6/1981 Hendrickson et al. ..... 166/278
4,722,392 A 2/1988 Proctor et al.
4,858,690 A * 8/1989 Rebardi et al. ..... 166/278
5,609,204 A * 3/1997 Rebardi et al. ..... 166/51
5,921,318 A * 7/1999 Ross ..... 166/250.17

(Continued)

FOREIGN PATENT DOCUMENTS

EP 0 724 065 A2 7/1996

(Continued)

OTHER PUBLICATIONS

Baker Hughes, Baker Oil Tools, Product Report, Sand Control Systems, 2002, 1-page.

*Primary Examiner*—Hoang Dang
(74) *Attorney, Agent, or Firm*—Tim Curington; Robin Nava

(57) ABSTRACT

A service/completion liner having a plurality of downhole selectable indicating tools and being used in sand control (gravel pack) placement systems in conjunction with a straddle packer service tools or with conventional crossover type service tools. Each indicating collar has a downhole selectable indicating collar providing a robust, landing profile for precisely locating and maintaining service tool position during well treatment operations. The landing collars accommodate hydraulic and/or thermal effects commonly referred to as tubing move effects which are the principle cause of tool position error and excessive seal wear. The landing collar is downhole convertible between a pass through (Go) and non pass through (No-go) condition by simple upward and downward cycling via the tool running and treatment fluid tubing and a shifting tool, which may also be referred to as a set down collet. The shifting/set down collet is also used to open and close a downhole sliding sleeve valve and may be an integral part of an injection tool or a tool for gravel or fracture packing. A sliding sleeve valve design and a straddle packer configuration that protects the primary PBRs in the gravel pack system and also protects the sliding sleeve while sand is placed in the screen casing annulus.

30 Claims, 9 Drawing Sheets

U.S. PATENT DOCUMENTS 6,202,742 B1 * 3/2001 Echols ..... 166/51
6,216,785 B1 4/2001 Achee, Jr. et al.
6,464,006 B1 * 10/2002 Womble ..... 166/276
6,494,256 B1 12/2002 Achee, Jr. et al.
6,722,440 B1 * 4/2004 Turner et al. ..... 166/374
2002/0117301 A1 * 8/2002 Womble ..... 166/278
2005/0178552 A1 * 8/2005 Fehr et al. ..... 166/305.1

FOREIGN PATENT DOCUMENTS

EP 0 724 065 A3 3/1999

* cited by examiner

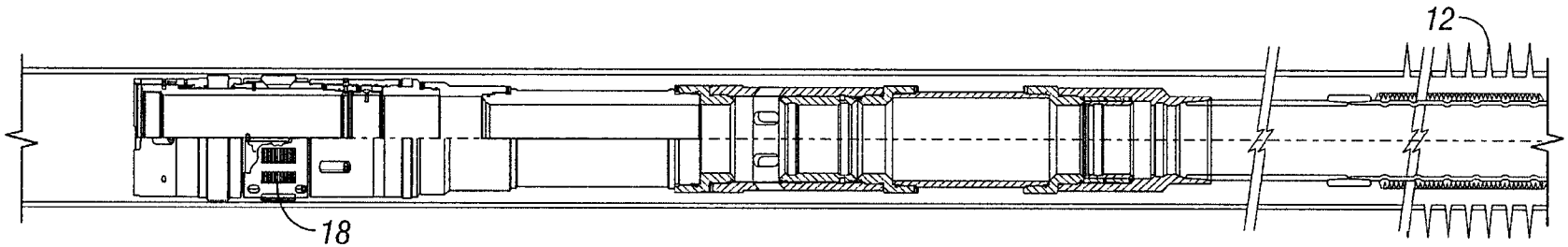
FIG. 1-A
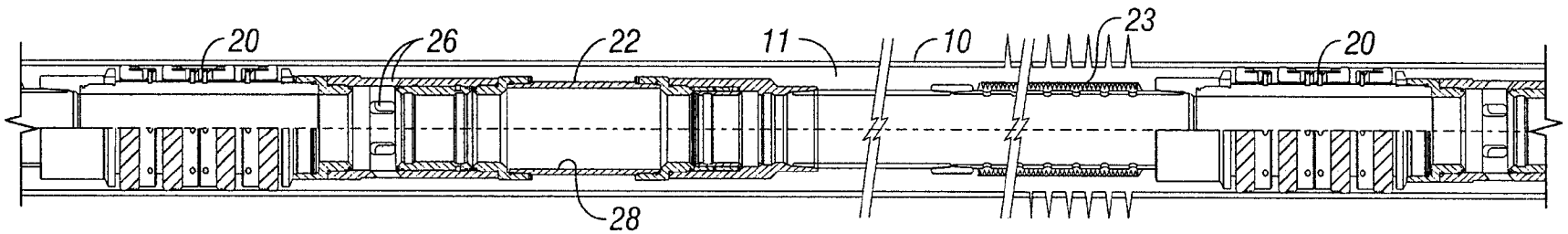
FIG. 1-B
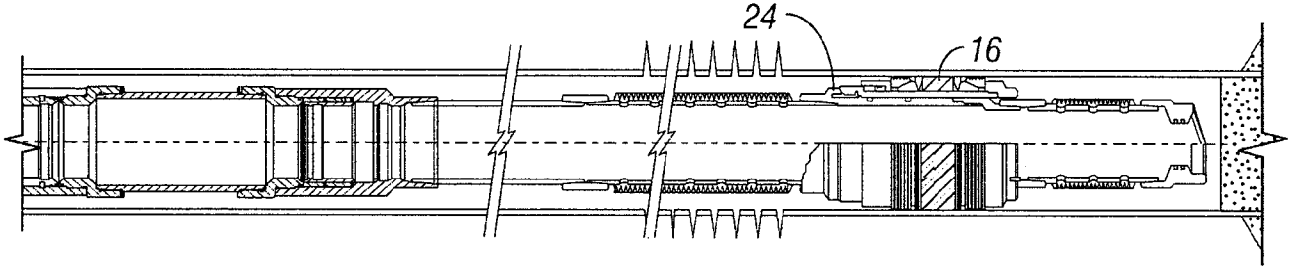
FIG. 1-C

METHOD AND APPARATUS FOR TREATING A SUBTERRANEAN FORMATION

CROSS-REFERENCE TO RELATED APPLICATIONS

Applicants hereby claim the benefit of U.S. Provisional Applications Ser. No. 60/439,640 filed Jan. 13, 2003 and entitled "Method and Apparatus for Treating a Subterranean Formation", which provisional applications are incorporated herein for all purposes.

Applicants also hereby incorporate herein by reference the subject matter of patent application Ser. No. 10/078,963, entitled "Tubing Conveyed Fracturing Tool and Method", filed Feb. 19, 2002, now issued as U.S. Pat. No. 6,776,239, and U.S. Provisional Application No. 60/275,270 entitled "Fracturing Tool for Coiled Tubing" filed Mar. 12, 2001. The tool disclosed therein is referred to hereinafter as the "Mojave™ tool".

BACKGROUND OF THE INVENTION

1. Field of the Invention

The present invention generally concerns tools and methods for accomplishing well treatment such as formation fracturing, proppant slurry injection, gravel packing, etc. More particularly, the present invention concerns a method and apparatus for treating multiple subterranean formations in a single trip, utilizing a coiled or jointed tubing conveyed well treatment tool which provides a means for a circulating or squeeze type treatment, and clean up via reversing out excess slurry by reverse flow or by discharging, i.e., dumping excess slurry internally into the well casing or "rat hole" below the tool. The present invention further concerns well treatment tools that are downhole convertible, thus having the capability of accomplishing selectable landing or locating the tool at a desired service tool position for well treatment and for opening and closing a sliding sleeve valve of the tool for efficient injection fluid flow control.

2. Description of Prior Art

The terms "service tool" or "service tool assembly" as used herein are intended to encompass many differing types of well treatment tools, including tools that are used during subterranean formation fracturing operations, including injection of proppant, i.e., sand/liquid slurry into formation fractures, gravel packing tools, tools for fluid injection operations for chemical treatment of subterranean oil and gas production formations and the like. For purposes of simplicity, to facilitate ready understanding of the present invention, the fracturing tool and the method of treating a subterranean formation are described herein particularly in relation to formation fracturing with proppant slurry.

The term "PBR" as used herein is intended to mean a "polished bore receptacle", which is an internal cylindrical surface having a close tolerance diameter and having a smooth, i.e., polished surface finish. PBRs are typically employed as internal sealing surfaces which are engaged by annular seal members to establish efficient sealing between components. The term "reverse out" as used herein is intended to mean reversing or changing the direction of flow down the well service tubing to and into the formation for treatment, so that the flow of treatment fluid, including clean-out fluid is diverted upwardly to the surface through a return passage such as may be defined by dual concentric tubing strings.

The term "reversing out", as employed herein, is intended to mean a fluid injection for well treatment having the capability for accomplishing fluid circulation type treatment where excess treatment fluid is returned to the surface for disposal by a return flow passage, such as can be provided when dual concentric fluid treatment tubing is utilized. In this case the central tubing string is employed to conduct treatment fluid to a downhole treatment tool and the annulus between the central tubing string and an outer tubing string defines the return flow passage.

Typical gravel pack tools are generally equipped with either a load indicating type collet or with a fixed shoulder for locating positions. The load indicating collet is designed to interfere with a fixed profile to the extent that a surface indication of a change of tubing load or resistance may be noted. This type of collet indicator is generally limited to a maximum load (under 20,000 lb) that may not be adequate to compensate for common tubing move effects. A fixed shoulder locator will only provide positioning of a well service tool at one location within a packer and packer extension within a well casing and may prevent repositioning of the well service tool to any point below that location.

An alternative to a selectable landing collar is a selectable collet which is part of a work string rather than part of the permanent completion. Selectable, or downhole convertible collets are currently available but are generally less robust, more susceptible to damage from excessive loads, and may not be suitable for multiple operation applications such as the actuation of other mechanisms like sliding sleeves.

Typical gravel pack jobs are performed with a service tool that seals in two PBRs. One PBR is located below the sliding sleeve valve and the bore of the gravel pack packer and the second PBR is located immediately above the sliding sleeve valve. The gravel pack service tool uses bonded seals rigidly attached to the service tool along its length to provide a seal in the PBRs. A cross-over port is located between two of the service tool seals and forces the gravel pack fluid thru the ports in the gravel pack sleeve. During high flow rate gravel packing jobs erosion damage can occur on the sliding sleeve housing bore which prevents the valve from sealing properly. Damage can also occur to the PBRs where they are exposed to the abrasive gravel packing fluid. In addition, sand can get into the sliding sleeve locking mechanism and prevent it from sliding into place or latching into the closed position.

The invention set forth in U.S. patent application Ser. No. 10/078,963, now issued as U.S. Pat. No. 6,776,239, is a multi-zone service/completion tool assembly, suitable for use in association with the apparatus and method of the present invention.

Components of the multi-zone service/completion tool assembly include:

The service/completion tool assembly uses cup type sealing elements to direct pumped fluids straight into the ported housing. Due to its configuration using less debris sensitive cup type sealing elements, and the ability to reverse out in the treatment position, screen-outs that may occur in the service/completion tool assembly become less critical and do not inhibit tool movement or the operation in subsequent zones. These are key features of the fracturing tool that is being used according to the method of the present invention.

The service tool system incorporates a mechanical valve which is primarily used to selectively close the wash pipe and open ports to enhance reversing out. The mechanical valve is actuated via axial movements of the tubing string. Reversing may be initiated in the treating position without string movement and may be continued while the closing sleeve is shifted closed via tubing string movement. The valve may be configured for either circulating or squeeze type treatments.

The service tool system includes an optional hydraulically actuated dump valve mechanism that allows excess formation treatment slurry to be discarded internally into the well sump or rat hole without any need to reverse the fluid flow in order to remove excess treatment fluid slurry from the service tool. This dump valve feature reduces the potential of sticking the service tool within the well casing, especially in the case of highly deviated or horizontal wellbores, and reduces multiple zone treatment cycle time. The hydraulic dump valve closes and opens a predetermined rate or pressure without the need to manipulate the tubing string to which the service tool is connected for fluid supply and for conveyance within the well casing.

The service tool is positioned precisely in front of the ported housing to construct an ideal flow path for slurry to the reservoir. In order to positively locate the position of the service tool within the service/completion liner, a landing collet must be connected to the service tool. This landing collet serves two purposes: 1) to locate and maintain the ideal position of the service tool for well formation treatment and 2) to close the sleeve valve of the service/completion liner after each zone is treated.

The landing collet is a "set down" collet that selectively locates in a selectable profile collar to maintain a downward set position. A lower zone isolation tool aids to isolate zones below from injection fluids and pressure and also creates a pressure balanced condition which eliminates upward hydraulic loads. The set down feature combined with the pressure balancing lower isolation tool, negates the need for an anchoring device, such as slips or an expandable cone to fix the tool within the well casing and prevent its movement during formation treatment.

The selectable profile (Go/No-go) collars which provide selectable landing shoulders allow the service tool to be precisely placed and maintained in any zone while injecting treatment slurry into a selected formation zone. The service tool may be retrieved or pulled to above the upper packer and returned to any zone set down position.

A one-time landing collet disabling sleeve provides a cost effective means to permit re-entering of lower zones.

In its simplest form the service tool is configured to perform the formation treatment in a "squeeze" mode; i.e. squeeze, meaning all fluids are injected into the formation and not circulated back to surface. A squeeze technique is applicable when a short length of formation interval is being treated. If required, shunting tools such as the AllPAC™/AllFRAC™ tubes can be run on the screen to avoid treatment slurry solids bridges. The addition of a downhole pack off (stripper) and a concentric string between the service tool and the top packer enhances reversing out and permits a circulating type treatment.

For zones intervals of equal length, (screens plus blank sections), a wash pipe and lower isolation assembly is placed through the screen to isolate the formation below and to cancel hydraulic effects that would otherwise tend to move the tool.

For unequally spaced zones or as an alternative to using wash pipe and the lower isolation assembly, a blind or internally closed screen may be used. With the zone isolated at the screen there is no need for the lower isolation assembly or wash pipe, the service tool ends at the landing collet and will permit only a squeeze type treatment technique to be employed.

The sleeve seal area of the ported housing is critical; the sleeve must be closed just after the treatment.

The closing sleeve acts primarily as an sand exclusion device and should be closed immediately after screen out to minimize the potential for proppant flow back. To contend with erosional effects two closing sleeve designs are utilized. For extreme rates or amounts of proppant, a long ported sleeve is recommended. The ported sleeve design protects the sealing surface by blocking erosion with a non-critical area of the tool. A less costly short sleeve relies on precisely directing the erosion effects away from the critical sealing surface.

To have the possibility to reverse out (Option II, as set forth below), two concentric strings of wash pipe need to be run between the top packer and the service tool; it can be either two independent strings or joints of pipe that have been made with adapter subs on top and bottom and with the annulus already assembled. An additional port will have to be added above the service tool, with a cup facing down on each side of the port; to reverse, fluid will be pumped into the annulus, out the port, around the bottom facing cup, into the pumping ports and up the tubing string; depending on the reservoir's resistance to treatment fluid injection, this will also require the use of a downhole pack-off, commonly referred to as a stripper below the top packer. Reversing out may commence once the treatment is completed by pumping down the casing/work string annulus, into the concentric service tool string annulus and around the inner isolating cup.

With the mechanical reversing/circulating valve, reversing out is enhanced by opening a flow path from the concentric tool string annulus into the lower area of the straddle or cup containment area. The flow path is opened and the lower wash pipe is closed off by raising the service tool string as little as 3 inches.

With the dump valve, in case the rat hole is full of treatment sand, the option is to pick-up the service tool into the blank pipe below the top packer into an area where only the bottom cups of the service tool effect a seal; the operator can then develop a reverse flow condition to remove the excess sand and can then run the service tool back down to its servicing position. A fixed screen below the sump packer is used to ensure separation of slurry while dumping in the lowest zone.

SUMMARY OF THE INVENTION

This present invention is for a selectable landing or locating apparatus and method of uses thereof that could be used in sand control (gravel pack) placement systems in conjunction with a straddle packer service tools or with conventional crossover type service tools. The selectable landing collar is used to provide a robust, landing profile for precisely locating and maintaining service tool position during pumping operations normally cause hydraulic and/or thermal effects. These effects are commonly referred to as tubing move effects and are the principle cause of tool position error and excessive seal wear. The landing collar may also be used to maintain tool position in operations run from floating rig applications.

The landing collar is downhole convertible between a pass through (Go) and non pass through (No-Go) condition by simple upward and downward cycling via the tubing and a shifting tool, which may also be referred to as a set down collet. The shifting/set down tool and collar are capable of supporting a large amount of tubing weight, in some applications the entire work string or tubing weight may be applied. The shifting/set down collet is also used to open and close a downhole sliding sleeve valve and may be an integral part of an injection tool such as the Mojave™ or Quantum™ service tool used for gravel or fracture packing.

The Go/No-go Collar, or selectable landing collar is used to provide a robust landing profile for precisely locating and maintaining a service tool or tubing position during pumping and/or in floating rig applications. The ability to precisely locate and land on a predetermined locating shoulder eliminates tool movement which results in less seal wear, allows ideal flow paths to minimize erosion, and minimizes operator error. The selectable feature facilitates deployment of the service string and offers the versatility of locating in any profile as often as necessary.

This invention provides a sliding sleeve valve and a straddle packer configuration that protects the primary PBRs in the gravel pack system and also protects the sliding sleeve while sand is placed in the screen casing annulus. The sleeve valve includes an unbalanced hydraulic area to assist in holding the sleeve open while treating or applying pressure via a mating cup sealing tool.

BRIEF DESCRIPTION OF THE DRAWINGS

So that the manner in which the above recited features, advantages and objects of the invention, as well as others which will become apparent, are attained and can be understood in detail, a more particular description of the invention, briefly summarized above, may be had by reference to the embodiments thereof documented in the drawings and accompanying text which follow. It is to be noted, however, that the drawings illustrate only typical embodiments of this invention, and are not to be considered limiting of its scope, for the invention admits to many other equally effective embodiments which vary only in specific detail.

In the drawings.

DETAILED DESCRIPTION

Figures 1, 1A:
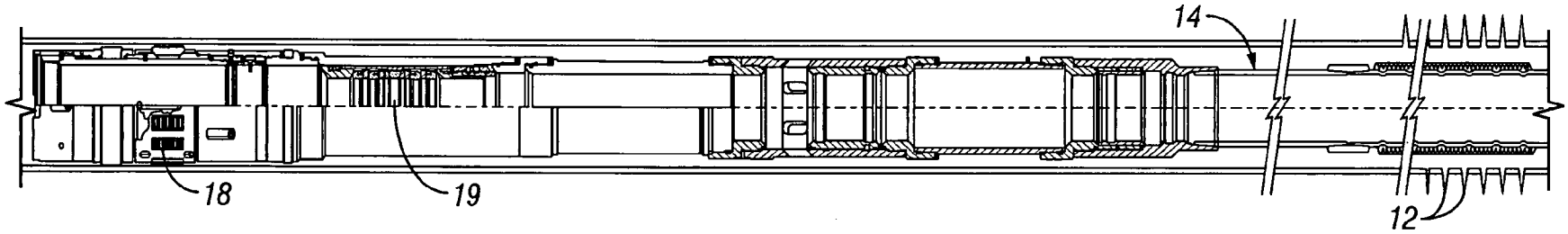
FIG. 1 is a longitudinal sectional view showing a well casing being perforated at a plurality of subsurface zones and with a multiple zone service/completion liner being anchored within the casing via a sump packer at the lower end and the Quantum™ seal bore packer or any anchoring type seal bore packer at the upper end. Cup type zone isolation packers for isolating the casing perforations of each of the zones are shown but may be replaced with hydraulic or inflatable types.
FIG. 1*a* is a longitudinal sectional view similar to that of FIG. 1 and showing a multiple zone service/completion liner that is adapted to receive a mechanical reversing valve for closing the wash pipe and open ports to facilitate reversing out after formation treatment has been completed for any particular zone.

Referring now to the drawings and first to FIG. 1, a well casing is shown generally at 10 and is perforated at a plurality of intervals as shown at 12 for completion of the well for production of petroleum products from a plurality of subsurface zones. Though the well perforations are shown to be substantially evenly spaced, it is to be understood that the casing perforations are typically located in unevenly spaced relation, the spacing thereof being determined by the location or depth and width of different subsurface zones of interest.

A service service/completion liner shown generally at 14, which is designed for use with a service tool having a hydraulically actuated dump valve, is shown to be located within the perforated well casing 10 and is adapted to latch into a sump packer 16 that establishes sealing within the well casing. The sump packer and isolates the multiple perforated zones of the well casing from pressure conditions below the lowermost perforated zone. The service/completion liner assembly is provided with an upper packer element 18 and is also provided with spaced isolation packers 20 and packer extension members 22 for each of the perforated zone of the well casing for isolating each of the multiple perforated zones from the other perforated zones. The isolation packer elements that are used in the service/completion liner assembly are preferably cup style packer elements. However, any isolation packer assembly which can be set hydraulically or mechanically in sequence and are constructed with an ID compatible with the service tool sealing members could be used. This generally includes hydraulic and inflate packers and also compression packers, which may be suitable if configured to be set in sequence prior to setting the setting the upper most packer. The packer extension members 22 are each of substantially identical length, and are provided with a screen 23 that may vary in length according to the width or thickness of a particular subsurface zone of interest for which treatment is desired. The screens 23 provide for fluid communication between the casing annulus 11 between the casing 10 and the service/completion liner 14.

Adjacent the sump packer 16 is provided an anchor latch assembly 24 having a polished internal diameter surface defining a PBR. The anchor latch assembly 24 efficiently and releasably anchors the service/completion liner 14 within the casing 10 to prevent the possibility of service/completion liner movement during high pressure injection of treatment fluid through the casing perforations and into the surrounding formation intervals. Each of the packer extension members 22 is provided with multiple fluid interchange ports 26 and defines an internal polished bore receptacle (PBR) 28. Each of the packer extension members 22 is also provided with a screen 30 to permit fluid interchange between the casing annulus and the internal flow passage of a well service tool, while excluding solid particulate, such as sand, during the treatment and production of the well.

Referring now to FIG. 1*a*, a service/completion liner that is similar to that of FIG. 1, and is designed for use with a service injection tool having a mechanical reversing valve for fluid circulation type servicing and completion, is referred to by like reference numerals representing like components. The service/completion liner of FIG. 1*a* differs from that shown in FIG. 1 in that the service/completion liner is provided with an internal pack-off apparatus 19, also referred to as a stripper, which is capable of being run into a well casing along with the service/completion liner, and thus does not require a separate trip into the well for its installation. The internal pack-off apparatus 19 is provided for sealing and wiping engagement with a well service tool that is run into the service/completion liner. The internal pack-off device 19 assists in enabling the service/completion liner and the well service tool to be run into the well casing in assembly, thus minimizing the number of tool trips into the well. It should be noted that the service/completion liner of FIG. 1*a* is designed particularly for use with a well service tool having a mechanical reversing valve to enable a reverse out well completion procedure rather than having a dump valve for dumping excess sand or proppant into the well casing or rat hole below the tool. However an internal pack-off mechanism is also applicable to well service tools with either a reversing valve or a dump valve. As mentioned above, for reverse out type formation treatment, a dual conduit string will often be employed, with the flow passage of the inner tubing used for treatment fluid injection and the annulus between the concentric tubing being used for reverse flow for conducting sand, proppant and the like to the surface for disposal or reclamation. In contrast, a dump valve type service tool achieves dumping of excess treatment slurry into the well below the tool.

Figures 1, 1A, 2:
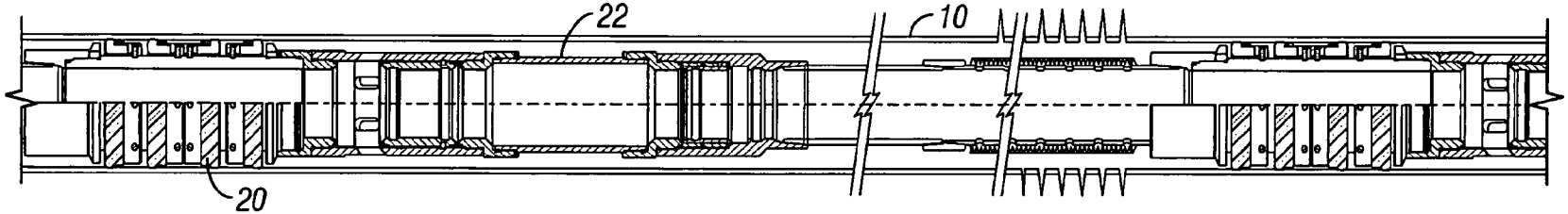
FIG. 2 is a longitudinal sectional view of a well service tool having a wash pipe spacer of sufficient length for treating a multiple zone well completion during a single trip of the treatment tool within the well and having an injection/locating assembly connected at the lower end of the wash pipe.

Referring now to FIG. 2, there is shown a service tool assembly generally at 32, such as the Quantum™ service tool, which is intended to be run into the service/completion liner assembly 14 and which incorporates a spacer pipe 34 of sufficient length to accommodate the combined spacing and length of the multiple perforations of the well casing. To the upper end of the spacer pipe 34 is connected a running/releasing mechanism shown generally at 33 and at the lower end of the spacer pipe 34 is connected an injection/locating assembly, generally shown at 36. The injection/locating assembly 36 is composed of a ported sub 35 located between sealing barriers 37 and 39. The injection/locating assembly 36, generally identified as the Mojave™ tool assembly, also includes a locating/shifting collet 42. An intermediate wash pipe 40 connects the injection/locating assembly 36 and a lower isolation assembly 41, which is shown in greater detail in FIG. 2*c*.

Figures 1, 2:
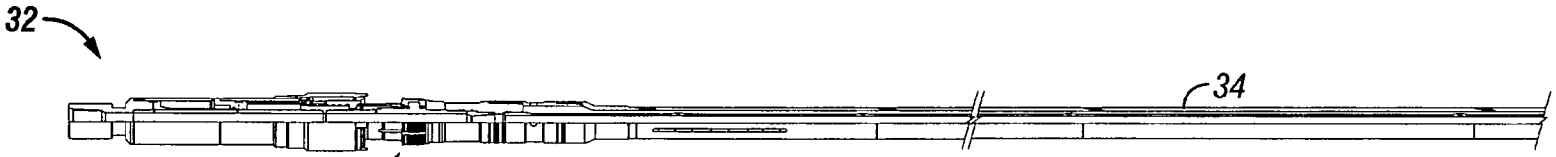
Figure 2:
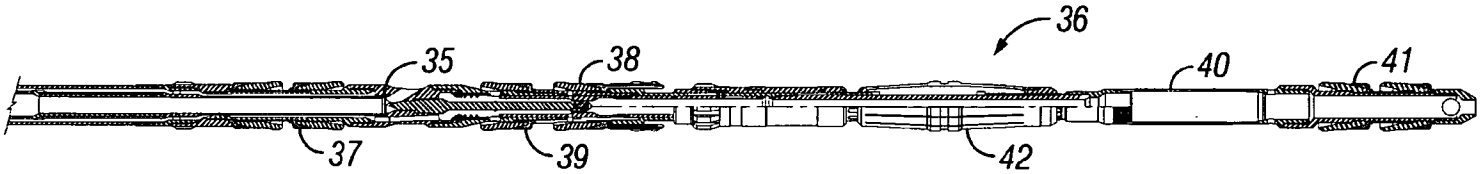
Figures 1, 2A:
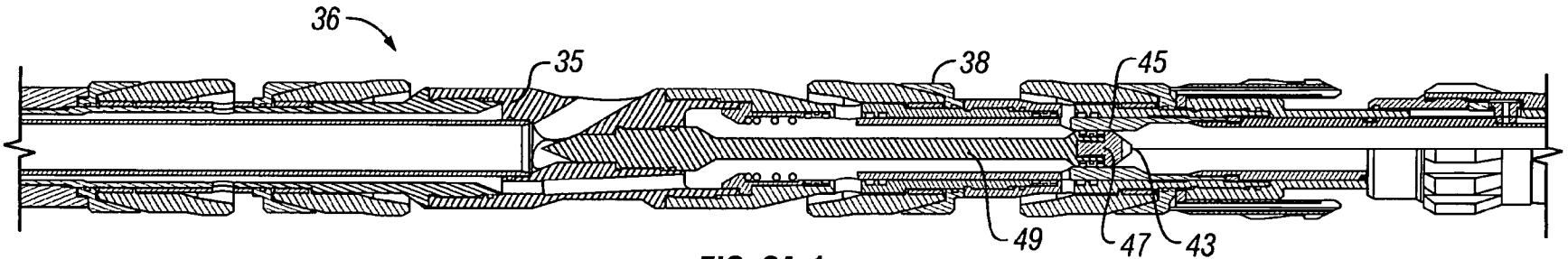
FIG. 2*a* is a longitudinal sectional view of the injection/locating assembly of FIG. 2, showing the mechanical reversing valve thereof in the closed position thereof.
Figures 2, 2A:
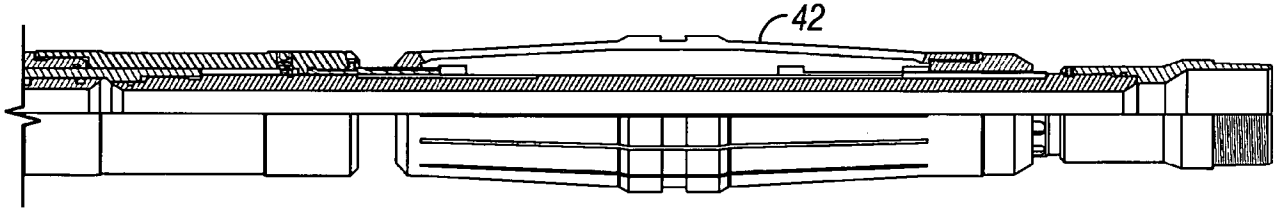
Figures 1, 2B:
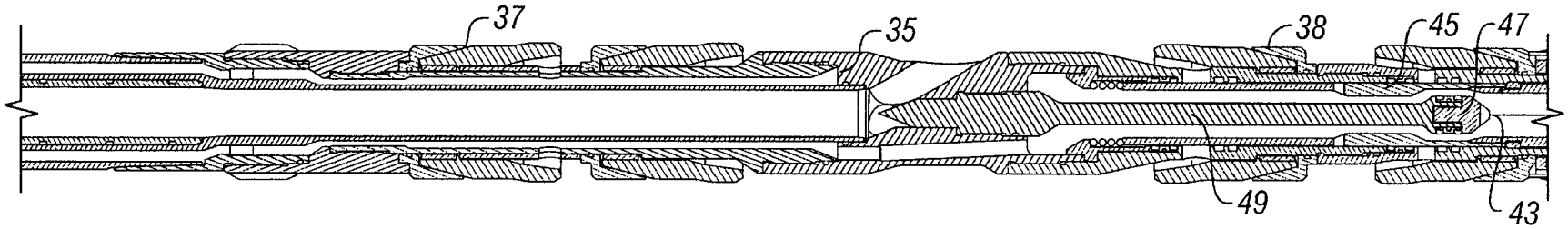
FIG. 2*b* is a longitudinal sectional view of the injection/locating assembly of FIG. 2*a*, showing the mechanical reversing valve thereof in the open position thereof.
Figures 2, 2B:
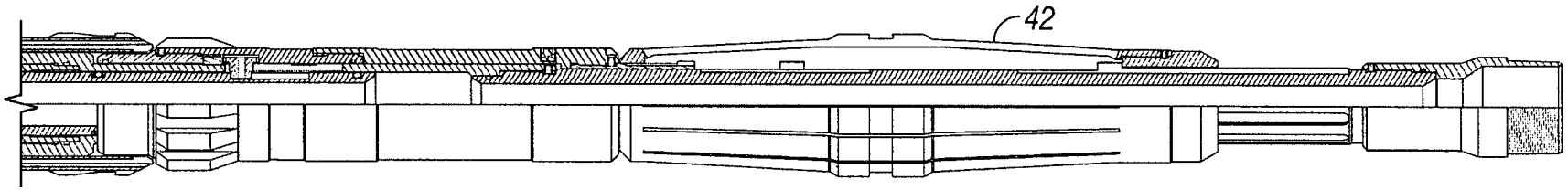
Figure 2C:
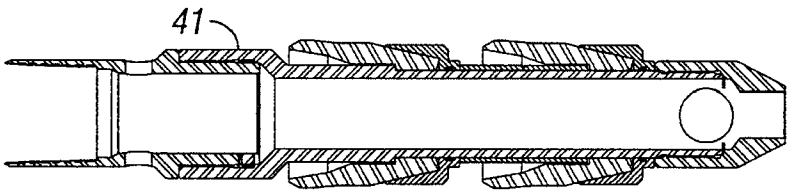
FIG. 2*c* is a longitudinal sectional view showing the lower isolation tool at the lower end of the service tool assembly of FIG. 2 in greater detail.
Figure 3:
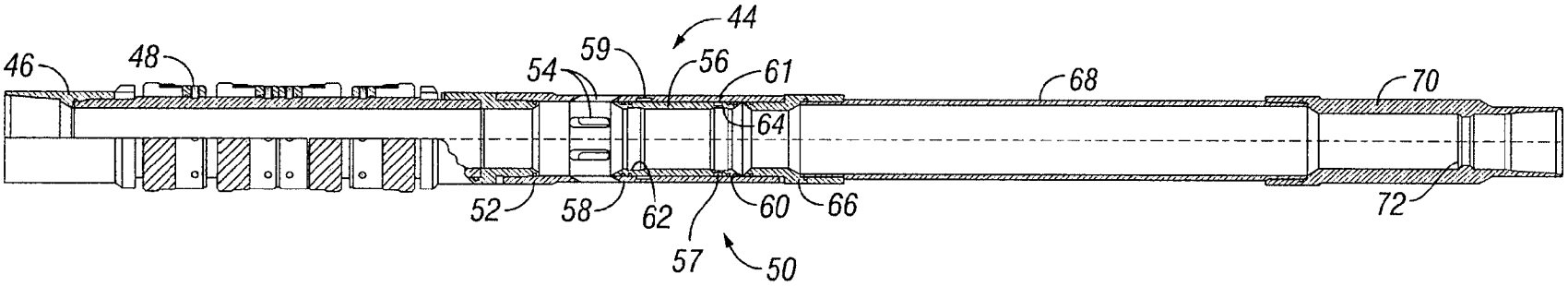

Referring to FIGS. 2*a*, 2*b* and 2*c*, the injection/locating assembly of FIG. 2 is shown in greater detail, with FIG. 2*a* showing a mechanical reversing valve 43 thereof in its closed position and with FIG. 2*b* showing the mechanical reversing valve in its open position. The open and closed positions of the mechanical reversing valve 43 are determined by the position of an internal tubular seat member 45 and a reversing valve element 47 which is mounted to a valve support member 49 that is fixed to the ported sub 35.

Figures 1, 1A, 2, 3:
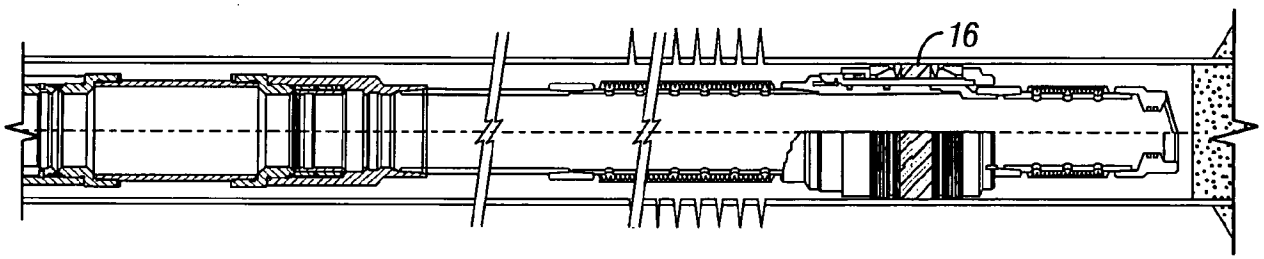
FIG. 3 is a longitudinal sectional view of a packer and packer extension having a packer, closing sleeve valve, a spacer and an indicating collar and being especially suitable for gravel packing operations.
Figure 4:
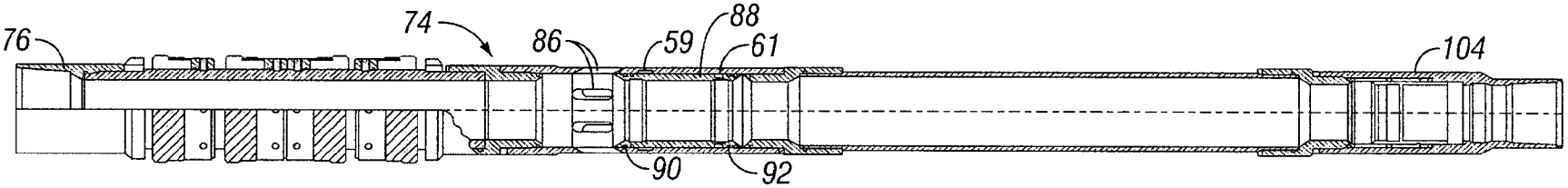
FIG. 4 is a longitudinal sectional view showing a packer and packer extension particularly suitable for formation fracturing treatment and having a packer, a closing sleeve valve, a spacer of desired length and having a downhole selectable Go/No-go collar in lieu of the indicating collar of FIG. 3 and further showing a sliding sleeve valve assembly at the open position thereof.
Figure 5:
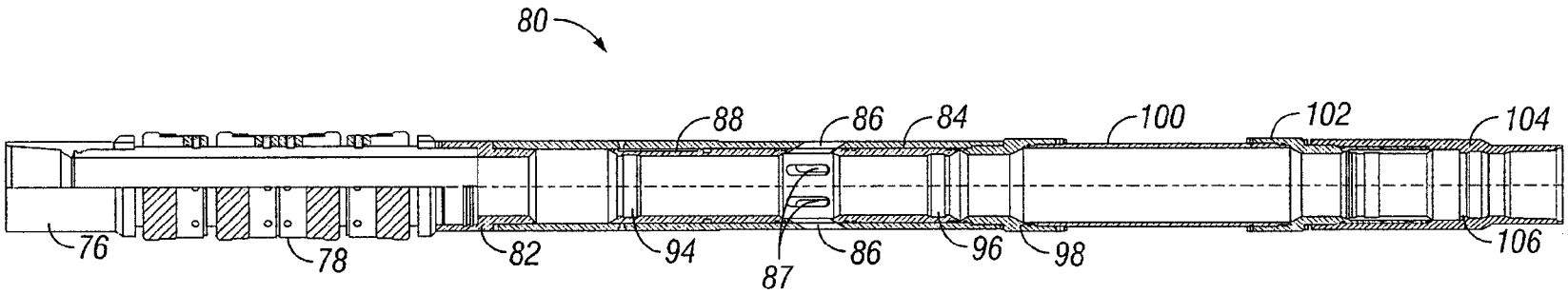
FIG. 5 is a longitudinal sectional view of the packer and packer extension of FIG. 4 and showing a long closing sleeve assembly at the down or open position thereof and with the downhole selectable Go/No-go collar thereof being disposed in the "land in" position for landing of a set-down tool on the set-down/landing shoulder or profile of the selectable Go/No-go collar.

It should be borne in mind that the service tool assembly 32 may have a variety of different forms, such as the gravel packing tool of FIG. 3 and the formation fracturing tool of FIGS. 4 and 5 without departing from the spirit and scope of the present invention. A sliding sleeve valve assembly shown generally at 50 is connected immediately below the packer assembly 48 and defines a tubular valve housing 52 having a plurality of fluid injection ports 54 through which treatment fluid flows from the tool into the casing annulus of a perforated casing zone. A PBR may replace the packer or may be placed between the packers without departing from the spirit and scope of the present invention. In the case of gravel packing, the treatment fluid is a slurry containing a high concentration of coarse sand that is employed to fill the annulus and provide a porous filtering pack that permits production fluid flow but restrains the volume of formation particulate contaminants that would otherwise be present in the production fluid. Within the tubular valve housing 52 is located a tubular sliding sleeve valve 56 having external seals 58 and 60 in sealing engagement with a PBR within the tubular valve housing. The tubular sliding sleeve valve 56 is provided with internal valve actuating profiles 62 and 64 that are engaged by corresponding valve actuating profiles of the well service tool 36 to move the sliding sleeve valve downward to its open position as shown in FIG. 3 or upwardly to its closed position with respect to the fluid injection ports 54. The tubular sliding sleeve valve 56 is also provided with a latch element 57 that establishes latching or retaining engagement within respective upper and lower latch recesses 59 and 61, thus retaining the sliding sleeve valve element 56 at its upper or lower positions until sufficient force is applied by the well service tool 36 to release and move it.

The sliding sleeve valve of the present invention is designed so that the ID of the sliding sleeve valve housing 52 is a PBR.(close tolerance diameter having a smooth surface finish). The ID of the sleeve valve is slightly larger than the bore of the other PBRs in the gravel pack system. The bore is sized so that standard bonded seals that will be used on completion seal assemblies do not contact the sliding sleeve when they pass through the bore. The bore is also sized so that the seal assembly on the straddle packer can form an effective pressure seal for the slurry placement.

The tubular valve housing 52 is provided with a spacer coupling 66 to which a tubular spacer member 68 is connected. The length of the spacer member 66 is determined by configuration of the service tool, whether or not the dump valve is used. An indicating collar is connected to the lower end of the spacer member 68 and is provided with an internal indicating profile 72 for precise landing of a Go/No-go collar of the well service tool 36 to thus achieve precise positioning of the well service tool without any requirement for precision depth calculation. The remaining length of the service completion liner interval is constructed with blank pipe and screen. The length of screen is determined by the length of perforations in the casings, and the blank pipe extends between the screen and the landing collar. A predetermined weak point commonly referred to as a safety shear sub (not shown) may be placed between the landing collar and blank pipe to provide a means for separation and retrieval. A safety shear sub is useful in the event the lower portion of the service tool should become stuck within the service/completion liner.

As shown in FIGS. 4 and 5, the well service/completion assembly of the service/completion liner may conveniently take the form similar to a formation fracturing extension, known as the Quantum™ Packer/Frac extension, which is shown generally at 74. The service/completion liner 74 is provided with an upper connector member 82 for connection with the packer assembly 78. Connector member 82 may also act as a PBR for use with hydraulic set type packers. Packer assembly 78 includes a connector for connecting to the screen of the zone above. A sleeve valve assembly shown generally at 80 is mounted to the packer assembly 78 by a housing connector 82. The sleeve valve assembly has a tubular valve housing 84 having a plurality of fluid injection ports 86 through which fluid is injected from the tool into the isolated casing annulus. The treatment fluid is injected into the casing annulus at sufficient pressure and volume to flow through the casing perforations and into the formation, causing fracturing of the formation so that production fluid will flow more readily from the formation, through the fractures and into the casing via the casing perforations. With respect to the embodiment of the service/completion extension shown in FIG. 5, the sliding sleeve valve member 88 may take the form of a long, ported tubular sliding sleeve valve having a plurality of ports 87 that are positioned in registry with the ports 86 of the tubular valve housing 84 when the sliding sleeve valve is at its open position. The longer sleeve valve provides erosion protection for the inner surface of the tubular valve housing and virtually eliminates the presence of internal voids that might collect sand or proppant that could interfere with valve operation.

As shown in FIGS. 4 and 5, a sliding tubular sleeve valve member 88 is located within the tubular valve housing 84 and carries internal seals 90 and 92 that are disposed in sealing engagement with the internal surface of the valve housing. The tubular sleeve valve member 88 is linearly moveable relative to the valve housing within limits defined by internal stop shoulders within the valve housing which are defined by the connected housing components. The tubular sleeve valve member 88 is provided with internal profiles 94 and 96 that are engaged during running or pulling of the well service tool 36 to cause the tubular sleeve valve member 88 to be shifted to its open position as shown in FIG. 4 or to its closed position as shown in FIG. 5 relative to the fluid injection ports 86 of the tubular valve housing.

The sliding sleeve valve of the present invention is designed so that the ID of the sleeve can take the form of a PBR (close tolerance diameter and smooth surface finish). The ID of the sleeve is slightly larger than the bore of the other internal surfaces of the gravel pack system. The bore is sized so that standard bonded seals that will be used on completion seal assemblies do not contact the sliding sleeve when they pass through the bore. The bore is also sized so that the seal assembly on the straddle packer can form an effective pressure seal for the slurry placement.

The sliding sleeve member 88 has three distinct seal areas. An upper seal area is located between the top of the sliding sleeve and the top of the radial ports in the sleeve. A middle seal area is located between the bottom of the radial ports and the top of the sliding sleeve locking mechanism. A lower seal area of sliding sleeve member 88 is located between the bottom of the sliding sleeve locking mechanism and the bottom of the sliding sleeve. The seal above the slurry port of the straddle packer is positioned in the upper seal bore of the sliding sleeve. The straddle packer seal below the slurry port is positioned in the middle seal bore. The ID of the sleeve below the ports is actually slightly larger than the area above to provide a net downward force when pressure is applied via the straddle packer. A third seal can be positioned in the lower seal bore to insure debris exclusion from the locking mechanism. The third seal is not required as debris will be excluded by the seal positioned in middle seal bore.

Though the tubular sleeve valve member 88 of FIG. 4 is shown to be non-ported, it should be borne in mind that it may be provided with flow ports 87, such as shown in FIG. 5 that are positionable in registry with the injection ports 86 of the tubular valve housing 84. This valve design can be employed in the event the abrasive fracturing or gravel packing slurry might otherwise cause excessive wear of the PBRs and interfere with efficient sealing of the sleeve valve. Also, it should be borne in mind that the length of the tubular sleeve valve and the distance of its linear travel between its open and closed positions may be controlled to minimize the potential for erosion of the PBRs or other internal surfaces by the abrasive treatment slurry.

A housing coupling member 98 is connected to the tubular valve housing 84 and provides for connection of a tubular spacer member 100 to the tool and packer extension. Coupling member 98 also includes an inside diameter and end profile to cause disengagement of the service tool 36 with the closing sleeve 88. An indicating connector 102 is preferably connected to the lower extremity of the tubular spacer member 100 and provides for support of a tubular Go/No-go indicating collar 104, also referred to as a selectable landing collar. Connector 102, like coupling member 98 also includes inside diameter and end profile to cause disengagement of the service tool 36 collet with the traveling sleeve of the Go/No-go collar. An optional configuration combines 98, 100 and 102 into one integrated member. As mentioned above, The Go/No-go landing collar, or selectable landing collar 104 is used to provide a robust, landing profile for precisely locating and maintaining a service tool or tubing position during pumping and/or to compensate for relative movement in floating rig applications. The ability to precisely locate and latch into a predetermined location eliminates service tool movement which results in less seal wear, allows ideal flow paths to minimize erosion, and minimizes operator error. The selectable landing collar feature facilitates deployment of the service or work string and offers the versatility of locating in any profile as often as necessary. The Go/No-go indicating collar 104 defines an internal indicating profile 106 that is adapted for indicating, i.e., tool positioning engagement by the set down locating collet 42 of the well service tool 36. As shown in greater detail in FIGS. 7, 8, 9 and 10, internally, the Go/No-go indicating collar 104 defines an annular internal receptacle 108 within which is located a tubular traveling sleeve control element 110 having one or more traveling sleeve control members such as control pins 112 that are disposed in guiding and controlling relation within the continuous J-slot 114 of a traveling sleeve 116. The traveling sleeve 116 is provided with an annular internal sleeve actuation profile 118 that is engaged by the collet members of an actuating collet, as explained in detail below, to cause selective positioning or indexing of the traveling sleeve 116 to establish the "Go" and "No-go" conditions of the indicating collar.

Figure 6A:
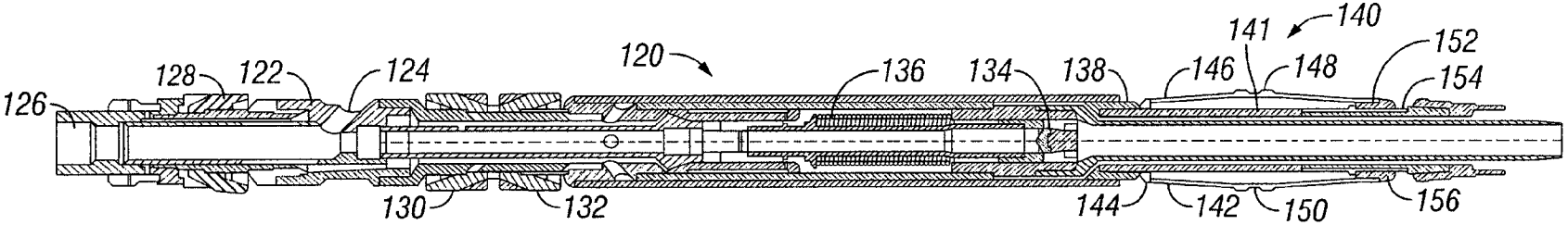
FIG. 6 is a longitudinal sectional view of a packer and formation service extension of a service/completion liner and showing a formation service tool disposed in superposed relation therewith for purposes of simplicity and to facilitate understanding, the formation service tool having a spring type collet for selective indicating engagement with an internal indicating profile of the Go/No-go landing collar of the packer and service extension.
Figure 6:
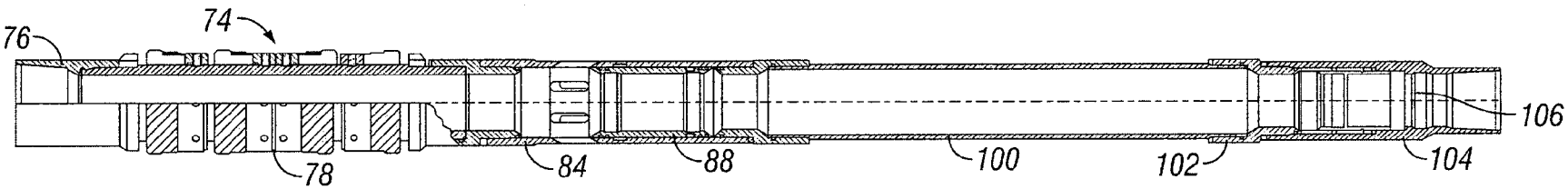

Referring now to FIG. 6, the packer/fracture extension with "Go/No-go" indicating collar of FIGS. 4 and 5 is shown and superposed therewith is a formation fracturing service tool known as the Mojave™ service tool shown generally at 120. The formation fracturing service tool 120 is generally positioned as if it were located within the packer/fracture extension 74. The formation fracturing service tool 120 defines a tool body 122 having fluid injection ports 124 through which fracturing slurry is injected into an annulus between the tool and the well casing. The formation fracturing service tool 120 is particularly designed to be run on a coiled tubing service or work string which is connected at 126 and carries cup type straddle packer elements 128 and 130 and a cup type lower packer element 132 to prevent casing pressure from bypassing the lower straddle packer element. The formation fracturing service tool 120 is actuated by flow responsive differential pressure and incorporates a dump valve 134 that is shown in its closed position in FIG. 6. The dump valve 134 is opened responsive to the condition of a J-slot tool actuation control system having "set", "treat", "dump" and "release" operating conditions or modes, with J-slot control occurring responsive to fluid flow through the tool and/or responsive to the application of pulling force on the tubing to which the tool is connected for fluid supply and conveyance. A detailed explanation of the construction and operation of the tubing conveyed fracturing tool is set forth in U.S. patent application No. 10/078,963, now issued as U.S. Pat. No. 6,776,239.

A tool housing 136 of the formation fracturing service tool 120 is provided with a collet mounting coupling 138 supporting a shifting/set down collet, shown generally at 140. The shifting/set down collet 140 incorporates a tubular collet support member 141 which depends from the collet mounting coupling 138. The tubular collet support member 141 defines an upper annular shoulder 142 which serves as an annular retainer to secure a collet support ring 144 in substantially immoveable relation with respect to the collet mounting coupling 138. A plurality of elongate, generally curved spring-like collet members 146 have ends that are fixed to the collet support ring 144 and have collet members 148 located intermediate the length thereof. The collet members 148 each define slot profiles 150 that have a slot geometry corresponding to the geometry of the internal indicating profiles of the various Go/No-go indicating collars the packer and formation fracturing extension 74. The tubular collet support member 141 defines an annular stop shoulder 152 and a generally cylindrical external surface section 154 on which is moveable a collet slide ring 156 to which the lower ends of the collet members 148 are fixed. As radially inward force is applied to the spring-like collet members 148, such as when the collet is run through restricted regions of the tool, the collet members 148 will be collapsed somewhat and the collet slide ring will be moved along the generally cylindrical external surface section 154. When this radially inward force on the collet members is dissipated, the spring-like collet members 148 will spring back to the original configurations thereof. Thus, the spring-like collet members 148 will be slightly collapsed when being passed through the Go/No-go indicating collar 104 and, depending on the position of a moveable traveling sleeve, will pass through the Go/No-go indicating collar or establish indicating engagement with the internal indicating or landing profile 106 thereof.

As indicated above, the landing collar 140 of the present invention is downhole convertible between a pass through (Go) and non pass through (No-go) condition by simple upward and downward cycling of the traveling sleeve element 116 via the fluid supplying and tool conveyance tubing and a shifting tool, which may also be referred to as a set down collet. The shifting/set down tool and collar are capable of supporting a large amount of tubing weight, in some applications the entire work string or tubing weight may be applied. The shifting/set down collet is also used to open and close the downhole sliding sleeve valve 88 and may be an integral part of injection tools such as the Mojave™ or Quantum™ service tools that are used for gravel packing or fracturing and fracture packing or propping.

Figure 7:
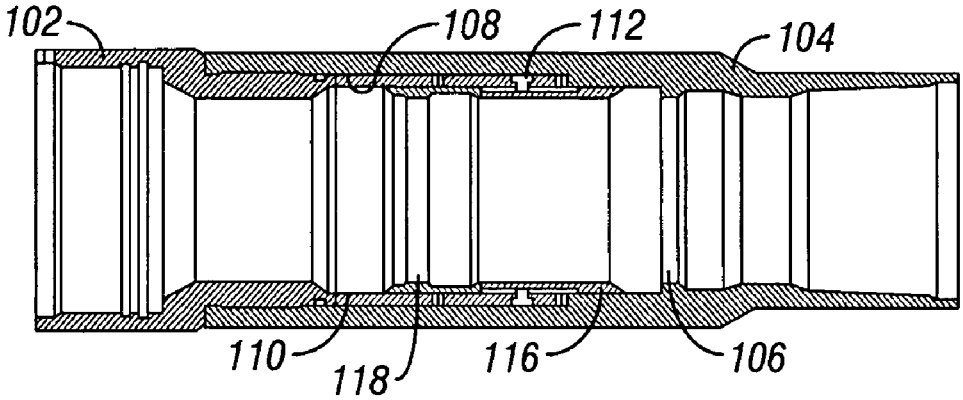
FIG. 7 is a sectional view showing the downhole selectable Go/No-go collar of FIG. 6 in greater detail and slowing the traveling sleeve in the intermediate "land-in" position thereof.
Figure 7A:
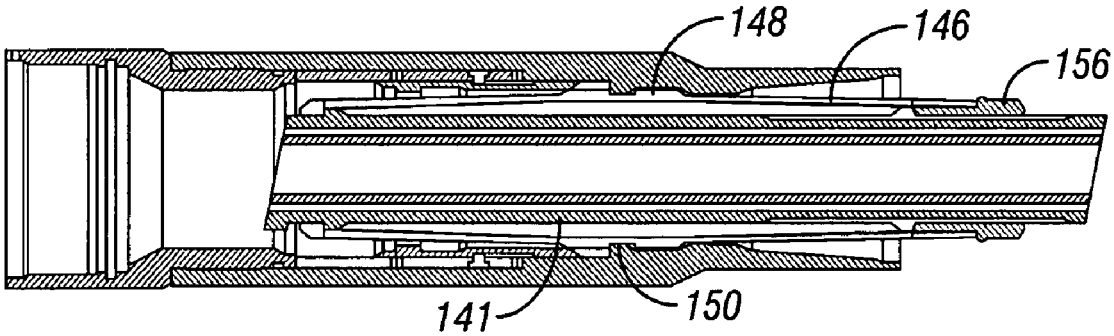
FIG. 7*a* is a longitudinal sectional view showing the downhole selectable Go/No-go collar of FIG. 7, showing the traveling sleeve thereof retracted to expose the internal indicating profile thereof and further showing the landing collet of the set-down section of a service tool in landed position therein.
Figure 7B:
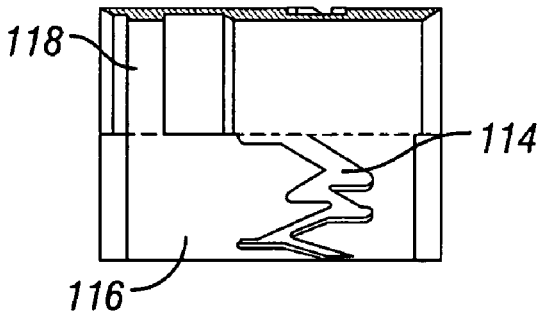
FIG. 7*b* is a partial sectional and partial elevational view showing the sliding or traveling "J" slot selector sleeve of FIG. 3, and showing the external "J" slot geometry thereof.
Figure 8A:
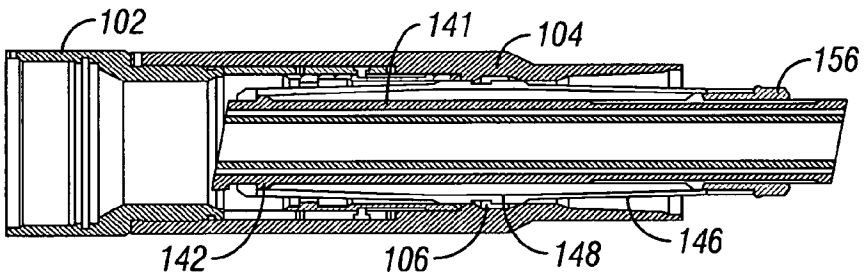
FIG. 8*a* is a longitudinal sectional view similar to that of FIG. 7*a*, with the traveling sleeve thereof in the "No-go" position and showing the landing collet of the set-down section of a service tool passing through the set-down or landing collar.
Figure 9A:
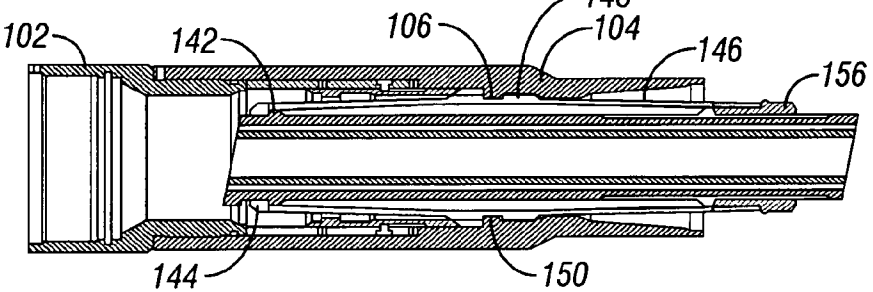
FIG. 9*a* is a longitudinal sectional view similar to that of FIG. 9 and showing the landing collet of the set-down section of a service tool landed on the internal indicating profile of the set-down or landing collar.
Figure 8:
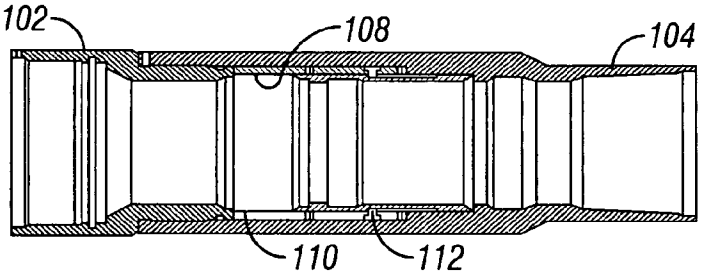
FIG. 8 is a longitudinal sectional view similar to that of FIG. 7 and in greater detail showing the sliding or traveling sleeve thereof being in the lower or "No-go" position thereof to prevent landing of the set-down tool on the internal indicating or landing profile of the indicating collar.
Figure 9:
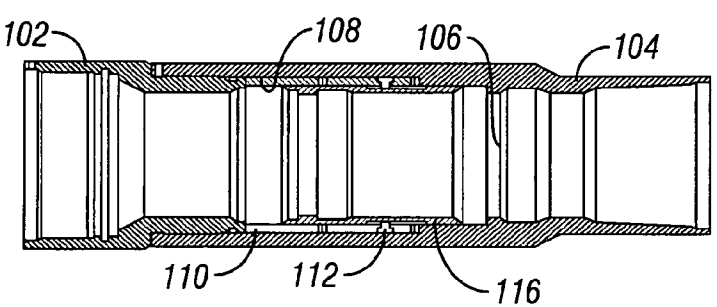
FIG. 9 is a longitudinal sectional view showing the Go/No-go indicating collar of the packer and service extension in the upper or "land in" position to permit landing of a well service tool on the internal landing or indicating profile thereof.
Figure 10A:
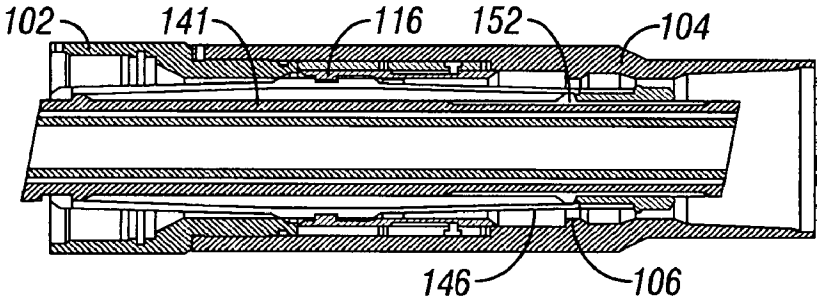
FIG. 10*a* is a longitudinal sectional view similar to that of FIGS. 8*a* and 9*a* and illustrating cycling of the traveling sleeve responsive to engagement of the spring-like collet with an internal actuation profile of the traveling sleeve element.
Figure 10:
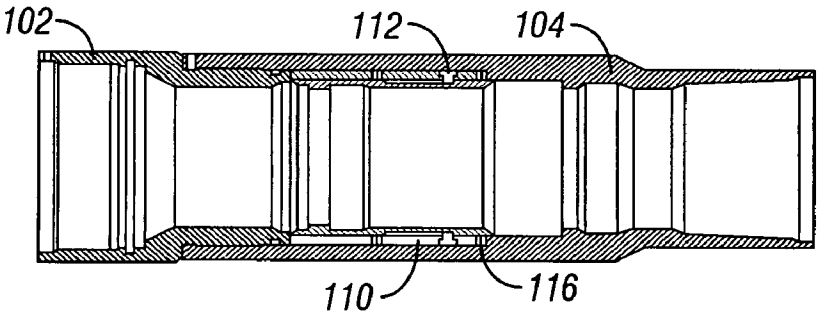
FIG. 10 is a longitudinal cross-sectional illustration similar to that of FIGS. 8 and 9 and showing the traveling sleeve of the landing/indicating collar in its uppermost position, to illustrate cycling of the J-slot of the traveling sleeve relative to the control pins to thus enable the traveling sleeve for movement to the "Go" or "No-go" positions thereof.

As shown in FIGS. 7 and 7*a*, the traveling sleeve 116 will have been cycled by upward and downward movement of the actuating collet assembly 140 by cycling of the work string to which the tool is connected, causing the traveling sleeve to be positioned intermediate the length of the annular internal receptacle 108, the "No-go" position, so that the internal indicating profile 106 is exposed. The service tool 120 is then moved downwardly until collet members 148 of the actuating collet assembly 140 are positioned with the slot profiles 150 thereof in landing engagement with the internal indicating profile 106. At this point, the actuating collet assembly 140 of the service tool will have been landed and will resist significant downward force of the service tool, including the entire weight of the service tool work string. The service tool will have been precisely positioned with the injection ports thereof oriented in desirable manner with respect to the straddle packer isolated casing interval and the casing perforations for efficiently conducting the intended well servicing operation.

After the well servicing operation has been completed and it is desired to provide similar well servicing operations at other packer isolated intervals within the well casing, the work string is pulled up from the landed position and the collet members 148 are positioned in actuating engagement with the annular internal sleeve actuating profile 118, thus establishing traveling sleeve actuation capability. The work string is then cycled upwardly and downwardly, causing the J-slot 114 to position the traveling sleeve 116 at its down or "Go" position within the annular internal receptacle 108, blocking the internal indicating profile 106. As the work string is then moved downwardly from this position, the collet members 148 will pass over the internal indicating profile 106 of the collar 104, thus allowing the well service tool to be moved downwardly to the next lower isolated casing annulus zone, where it will be employed to cycle the traveling sleeve of the indicating collar thereof to the "No-go" position if need be and then accomplish landing on the exposed internal indicating profile 106 to precisely indicate the well service tool for the intended service operation.

Figure 11:
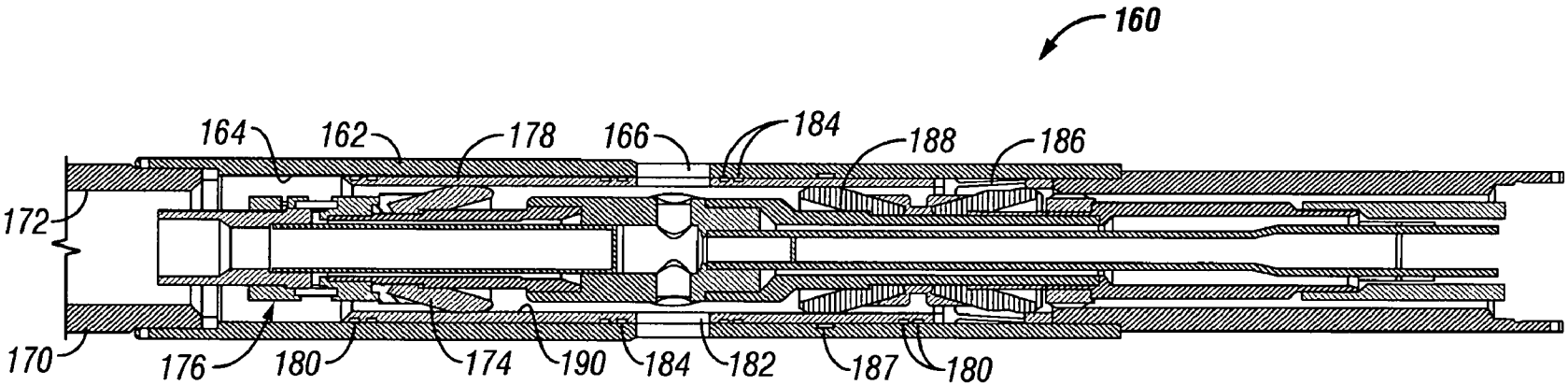
FIG. 11 is a longitudinal cross-sectional illustration showing an alternative embodiment of the present invention wherein a packing extension for receiving a straddle packer well service tool is provided with a long ported sliding sleeve valve that is capable of being locked in the open or closed position thereof.

As shown in FIG. 11, an embodiment of the present invention is shown, wherein a packer extension to which a "Go/No-go" indicating collar is mounted is shown generally at 160. The packer extension incorporates a sliding sleeve valve housing 162 which may have one or more internal sealing surfaces 164 and having injection ports 166. To the sliding sleeve valve housing 162 is connected a tubular spacer member 168 forming a part of the tool housing. A "Go/No-go" indicating collar is mounted to the spacer member such as is shown in FIGS. 4 and 5. A packer mandrel 170 is connected to the upper end of the sliding sleeve valve housing 162 and is provided with one or more internal packer surfaces 172, which may take the form of PBRs to permit other tools to establish a substantially sealed relation within the PBRs if desired.

Within the sliding sleeve valve housing 162 is located a tubular sliding sleeve valve element 178 having external annular seals 180 having sealing engagement with the internal surfaces 164. The tubular sliding sleeve valve element 178 defines an injection port 182 intermediate the extremities thereof and is provided with external port seals 184 that are disposed in sealing engagement with the internal surfaces 164 of the sliding sleeve valve housing 162. The tubular sliding sleeve valve element 178 defines an unbalanced area, thus making it pressure responsive so that it is urged in one axial direction. A locking mechanism 186 is provided within the sliding sleeve valve housing 162 immediately below the sliding sleeve valve and when moved upwardly into locking engagement within an annular locking recess 187 within the sliding sleeve valve housing 162 serves to retain the tubular sliding sleeve valve element 178 at the valve closed position thereof until such time as the locking mechanism is released. It should be noted that the cup packer elements 174 and 188 establish sealing on the internal cylindrical surfaces 190 of the tubular sliding sleeve valve element 178. These internal cylindrical surfaces ensure efficient sealing of the cup type packer elements in the presence of the abrasive treatment slurry that is used for formation fracturing and gravel packing operations.

When well treatment slurry is pumped into the screen casing annulus the straddle packer seals restrict the slurry flow to the area immediately adjacent to the sliding sleeve ports. The seal surfaces of the sliding sleeve housing are protected from erosion by the sliding sleeve. The sliding sleeve is positioned so that the radial holes or ports in the sleeve valve element align with the radial injection holes or ports in the sleeve housing. Erosion damage occurs primarily on the sliding sleeve in the port area. This arrangement also protects the primary internal surfaces or PBRs from abrasion since no slurry is pumped past these surfaces.

After the gravel pack is completed the straddle packer tool is removed from the gravel pack system. A shifting collet located to the lower end of the straddle packer service tool latches into the sliding sleeve valve. The collet moves the sliding sleeve upwardly from the valve open position of FIG. 11 to the closed position. When the sleeve valve locks into the closed position the shifting collet is released and passes through the annular internal surface 172.

The apparatus of the present invention may be interconnected according to various well treatment processes. As set forth below, three optional well treatment processes are briefly set forth which are:

- Option I. Single Trip System with dump valve
  - Set sump packer (e.g. run on wire line, correlate on depth, set sump packer)
  - Perforate intervals
  - Make-up outer string assembly comprising:
    - locator seal assemblies,
    - sand screens (Short length 10–60 ft)
    - Gravel pack extension ported housings with closing sleeve, run closed, the closing sleeve having a short extension on both sides to hold the cups of the service tool as well as a Go/No-go collar to hold the service tool during the pumping operation Blank pipe, if necessary for space-out reasons and
    - Packers for isolation purposes, with polished bore for the production isolation assembly.
  - Make-Up service tool comprising seals, wash pipe, indicator collet and Mojave™ tool, and may include swivel or non-rotational connector
  - Make-Up top packer assembly (contains setting mechanism to washpipe/service tool/outer string assembly, top packer, extension, and packer setting mechanism)
  - Run assembly in hole
  - Set gravel packer (e.g. Quantum™ packer) using a setting ball or against rat hole.
  - Release service tool comprising Mojave™ tool
  - Pick-up service tool and pull Mojave tool first perforated zone
  - Pick-up Mojave tool above the screens to find position #1
  - Close dump valve by positioning tool in blank section above the closing sleeve
  - Gravel pack or frac pack first zone
    - Locate position
    - Set down weight
    - Pump treatment
      - Break circulation with brine
      - Pump sand slurry
    - After screen-out, actuate dump valve (clear the tool)
    - Dump excess slurry in rat hole and/or completion string. Alternatively place excess slurry in an area outside of the seal area of the upper cups
  - Pick-up Mojave tool to locate the Go/No-go collar in the second perforated zone Close dump valve by positioning tool in blank section above the closing sleeve
Repeat gravel pack steps for subsequent zones
Pick-up and pull out of hole Option II. Single Trip System with Reversing Capability
Set sump packer (e.g. run on wire line, correlate on depth, set sump packer)
Perforate intervals
Make-up outer string assembly comprising:
seal assemblies,
sand screens (Short length 10–60 ft)
Gravel pack ported housings with closing sleeve, run closed, the closing sleeve having a short extension on both sides to hold the cups of the service tool as well as a collar on the top side to hold the service tool during the pumping operation Blank pipe, if necessary for space-out reasons, packers for isolation purposes, with polished bore for the production isolation assembly, and a downhole stripper installed under the top packer
Make-Up service tool comprising seals, outer and inner wash pipe to create an annulus that will be used to reverse out the slurry, indicator collet and Mojave™ tool, and swivel
Make-Up top packer assembly (contains setting mechanism to washpipe/service tool/outer string assembly, top packer, extension, and packer setting mechanism)
Run assembly in hole
Set gravel packer (e.g. Quantum™ packer) with setting ball or against rat hole.
Release service tool comprising Mojave™ tool
Pick-up service tool and pull Mojave tool to locate Go/No-go collar in the first perforated zone
If hydraulic set packer is used, pick-up Mojave tool to setting position and apply setting pressure
Gravel pack first zone
Locate position
Set down weight
Pump treatment
Break circulation with brine
Pump sand slurry
After screen-out, start reversing out by pumping fluid into the annulus
Actuate reversing valve to make sure no sand is left in the Mojave tool
Pick-up Mojave tool to locate in the Go/No-go collar of the second perforated zone
Repeat gravel pack steps described above for subsequent zones
Pick-up and pull out of hole Option III. Dual Trip CoilFRAC™ System (a CoilFrac™ System is described in U.S. Pat. No. 6,446,727, incorporated herein by reference).
Set sump packer (e.g. run on wire line, correlate on depth, set sump packer)
Perforate intervals
Make-up outer string assembly comprising:
seal assemblies,
sand screens (Short length 10–60 ft)
Gravel pack ported housings with closing sleeve, run closed, the closing sleeve having a short extension on both sides to hold the cups of the service tool as well as a collar on the top side to hold the service tool during the pumping operation Blank pipe, if necessary for space-out reasons, and cup packers for isolation purposes with polished bore for the production isolation assembly
Make-up top packer assembly (contains setting mechanism) to washpipe/service tool/outer string assembly comprising top packer, extension, and packer setting mechanism
Run assembly in hole
Setting and sequence
Set top packer (e.g. with the secondary ball in the secondary ball seat (the ball is then reversed out) or with a ball and a ball trip sub, the ball then falls in the rat hole
Release service tool
Pump out ball or reverse it out
Pull out of hole
CoilFRAC™ Gravel pack
RU injector head onto riser
Make-up Mojave™ tool assembly consisting of seals, wash pipe, indicator collet and Mojave™ tool
Run in hole with CoilFRAC™ Mojave™ tool assembly
Zone #1 gravel pack
Locate position
Set down weight
Pump treatment
Break circulation with fluid
Pump sand slurry
After screen-out, actuate dump valve (clear the tool)
Dump excess slurry in rat hole and/or completion string
If the rat hole is full of sand, an alternative is to pick-up the Mojave™ tool up to the top packer and place it in an area where the upper cups do not seal; the operator can then reverse out the excess slurry and go back down to continue the treatment
Pick-up Mojave™ tool into the screens of the second perforated zone
Close dump Valve by positioning tool in blank section
Pick-up Mojave™ tool above the screens to find second position
Repeat gravel pack for subsequent zones
Pick-up and pull out of hole As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for treating a subterranean formation intersected by a well casing that is perforated at a plurality of subsurface zones, comprising:

positioning within the well casing a service/completion liner assembly having a tool passage and having a plurality of interconnected packer/indicating extension tools isolating each of said plurality of subsurface zones and defining a plurality of isolated casing annulus zones within the well casing, each of said packer/indicating extension tools having at least one injection port and having a sliding sleeve valve assembly being moveable to open and closed positions relative to said at least one injection port, each of said packer/indicating extension tools having a downhole convertible indicating collar defining an internal indicating profile and being selectively convertible to a "Go" condition preventing the landing of well treatment tools on said internal indicating profile thereof and a "No-go" condition exposing said internal indicating profile thereof for landing of a well service tool thereon;

running a well service tool into said tool passage of said service/completion liner assembly and into a selected packer indicating extension tool thereof and moving said sliding sleeve valve assembly to the open position thereof and actuating the selected downhole convertible indicating collar thereof to said "No-go" condition;

landing said well service tool on said internal indicating profile of the selected downhole convertible indicating collar, thus communicating said well service tool with a selected isolated casing annulus zone via said at least one injection port of the selected packer/indicating extension tool; and conducting well treatment by injecting well treatment fluid from said well service tool through said at least one injection port into the respective isolated casing annulus and through the casing perforations of the respective isolated casing annulus into the surrounding formation.

2. The method of claim 1, wherein an internal packoff device establishes sealing and wiping relation with said well service tool, said method comprising:

mounting said internal packoff device within said service/completion liner;

running said service/completion liner and said internal packoff device into the well casing simultaneously; and establishing sealing engagement of said internal packoff device with said well service tool upon running of said well service tool into said service/completion liner.

3. The method of claim 1, wherein an internal packoff device establishes sealing and wiping relation with said well service tool, said method comprising:

mounting said internal packoff device within said service/completion liner;

assembling said well service tool within said service/completion liner and establishing sealing engagement of said internal packoff device with said well service tool;

running said service/completion liner, said internal packoff device and said well service tool into the well casing simultaneously.

4. The method of claim 1, wherein said step of running a well treatment tool into said tool passage of said service completion liner assembly and into a selected packer and indicating extension tool thereof comprising:

successively actuating said packer/indicating extension tools above the selected packer and indicating extension tool to said "Go" conditions thereof and moving said well treatment tool into the selected packer/indicating extension tool and converting the selected packer and indicating extension tool to said "No-go" condition; and landing said well service tool on said internal indicating profile thereof.

5. The method of claim 1, comprising:

with the well service tool, converting selected "Go/No-go" indicating collars to the "Go" positions thereof and passing said well service tool therethrough;

with the well service tool converting a selected "Go/No-go" indicating collar of a selected isolated casing annulus zone to the "No-go" condition thereof exposing said internal indicating profile thereof for well service tool landing;

landing said well service tool on the exposed internal indicating profile of the selected "Go/No-go" indicating collar; and conducting well treatment operations within the selected isolated casing annulus zone associated with the selected "Go/No-go" indicating collar.

6. The method of claim 1, wherein each of said downhole convertible indicating collars have a traveling sleeve therein defining a J-slot and having at lease one traveling sleeve movement control element within said J-slot and selectively controlling positioning of said traveling sleeve at an intermediate "No-go" position exposing said internal indicating profile for tool landing within said downhole convertible indicating collar and a lower "Go" position blocking said internal indicating profile and preventing tool landing within said downhole convertible indicating collar, said step of converting comprising:

establishing actuating connection of said well service tool with said traveling sleeve;

cycling said traveling sleeve upwardly and downwardly until said J-slot and control element establishes desired positioning of said traveling sleeve at said "No-go" position for tool landing or at said lower "Go" position for passage of said well service tool therethrough;

successively passing said well service tool through selected "Go/No-go" indicating collars to the isolated casing annulus zone of interest; and with said traveling sleeve of a selected "Go/No-go" indicating collar at said "No-go" position thereof landing said well service tool on the internal indicating profile thereof to permit treatment of the isolated casing annulus zone of interest.

7. The method of claim 1 wherein each of said downhole convertible indicating collars have a traveling sleeve therein defining a J-slot and having at lease one sleeve movement control element within said J-slot and controlling positioning thereof at an intermediate "No-go" position exposing said internal indicating profile for tool landing within said downhole convertible indicating collar and a lower "Go" position blocking said internal indicating profile and preventing tool landing within said downhole convertible indicating collar and wherein an actuating collet assembly is mounted on the well service tool and provides a landing and indicating collet members each having at least one indicating profile engaging element, said method comprising:

establishing releasable connection of said indicating profile engaging element with said internal traveling sleeve actuating profile;

moving said service tool upwardly and downwardly and cycling said traveling sleeve element until said traveling sleeve is located at said intermediate "No-go" position by said position control element and said J-slot; and moving said well treatment tool until said indicating profile engaging element establishes landing and indicating engagement with said internal indicating profile.

8. The method of claim 1, wherein said sliding sleeve valve assembly having a valve housing defining said injection ports and a sliding sleeve valve element being linearly moveable within said valve housing between open and closed positions and having an internal valve sleeve actuating profile, said step of moving said sliding sleeve valve assembly comprising:

engaging said internal sleeve actuating profile with said well service tool during downward movement thereof and moving said sliding sleeve element to said open position;

continuing downward movement and landing of said well service tool; and when closure of said sliding sleeve element is desired, moving said well service tool upwardly and establishing engagement thereof with said internal sleeve actuating profile and continuing said upward movement of said well service tool and moving said sliding sleeve element to said closed position thereof.

9. The apparatus of claim 7, comprising:

an internal packoff device within said service/completion liner establishing sealing and wiping engagement with said well service tool when said well service tool is located within said service tool passage.

10. The apparatus of claim 9, comprising:

said service/completion liner, said internal packoff device and said well service tool being assembled at the surface and simultaneously run into the well casing; and a service tool conduit string being connected downhole with said well service tool.

11. Apparatus for treating a subterranean formation intersected by a well casing that is perforated at a plurality of subsurface zones, comprising:

a service/completion liner assembly having a plurality of interconnected packer/indicating extension tools isolating each of said plurality of subsurface zones and defining a plurality of isolated casing annulus zones within the well casing, said service/completion liner assembly defining a service tool passage;

said interconnected packer/indicating extension tools each having fluid injection ports and a sliding sleeve valve assembly being moveable to open and closed positions relative to said fluid injection ports, each of said packer/indicating extension tools having a downhole convertible indicating collar mechanism defining an internal indicating profile and having a "Go" condition preventing the landing of well service tools on said internal indicating profile and a "No-go" condition exposing said internal indicating profile for landing of well treatment tools thereon; and a well service tool adapted for conveyance into and through said service tool passage and having an actuator collet adapted for selective converting actuation of said downhole convertible indicating collar assembly to said "Go" condition and said "No-go" condition.

12. The apparatus of claim 11, comprising:

a latch member releasably latching said sliding sleeve valve assembly at said open and closed positions thereof and being releasable from latching condition upon application of predetermined linear force thereto by said well service tool.

13. The apparatus of claim 11, comprising:

an actuating collet being mounted to said well service tool and selectively actuating said sliding sleeve valve assembly to said open and closed positions thereof.

14. The apparatus of claim 13, comprising:

a traveling sleeve being moveable within said indicating collar assembly to a "go" position preventing landing of said service tool on said internal indicating profile and a "no go" position exposing said internal indicating profile for service tool landing thereon; and said actuating collet selectively establishing actuating engagement with said sliding sleeve valve assembly and said traveling sleeve for actuation movement thereof.

15. The apparatus of claim 11, comprising:

said sliding sleeve valve assembly having a tubular valve housing defining said injection ports and defining internal spaced latch recesses;

a sliding sleeve valve element being moveable within said tubular valve housing to an open position permitting fluid flow through said injection ports and a closed position blocking flow through said injection ports; and a latch member being mounted to said sliding sleeve valve element and establishing releasable retaining engagement with respective latch recesses at said open and closed positions of said sliding sleeve valve element, said latch member releasing from a respective latch recess upon application of predetermined valve releasing force thereto by said well service tool.

16. The apparatus of claim 11, wherein said downhole convertible indicating collar assembly comprising:

a tubular indicating collar defining an internal indicating profile;

a traveling sleeve being moveable within said tubular indicating collar to positions establishing said "Go" and "No-go" conditions; and at least one sleeve control member projecting within said tubular indicating collar and having condition controlling engagement with said traveling sleeve.

17. The apparatus of claim 16, comprising:

at least one actuating profile being defined within said traveling sleeve and being releasably engaged for movement control by said well service tool, said well service tool being selectively cycled by said well service tool to cycle said traveling sleeve to said "Go" and "no-go" conditions thereof.

18. The apparatus of claim 16, comprising:

an annular internal receptacle being defined by said indicating collar; and an annular traveling sleeve control element being located within said annular internal receptacle and supporting at least one control pin within said J-slot and controlling rotary and linear motion of said traveling sleeve to said "Go" and "no-go" conditions thereof.

19. The apparatus of claim 11, comprising:

said well service tool being of sufficient length to extend substantially the length of said service completion liner assembly and having an upper packer element and an isolation wash pipe;

a well service mechanism being mounted to said isolation wash pipe and having an isolation seal assembly for selective sealing at desired locations within said service completion liner assembly, said well treatment tool further having a set down indicating collar defining a tool indicating profile;

an annular internal receptacle being defined within said set down indicating collar;

a traveling sleeve control element being located within said annular internal receptacle and having at least one control projection thereon; and said converting actuator being a traveling sleeve member having an external J-slot within which said control projection is received and which controls rotational and linear positioning movement of said traveling sleeve member to a "Go" position permitting landing of said well service tool on said internal indicating profile and to a "No-go" position preventing landing of said well service tool on said internal indicating profile.

20. The apparatus of claim 11, comprising:

said traveling sleeve member defining an annular internal sleeve actuation profile; and an actuating and landing collet assembly being supported by said well treatment tool and having a plurality of collet members each defining a slot profile for cycling engagement with said annular internal sleeve actuation profile and for landing engagement with said internal indicating profile.

21. The apparatus of claim 20, wherein said actuating and landing collet assembly comprising:

a tubular collet support member being mounted to said well treatment tool;

said plurality of collet actuator members each being of elongate generally curved configuration and having spring-like characteristics and having a first end thereof disposed in substantially immoveable relation with said tubular collet support member and a second end thereof being disposed in moveable relation with said tubular collet support member, said plurality of collet actuator members being radially expandable and collapsible responsive to engagement with internal surfaces of said packer/indicating extension tools during movement of said well service tool therein; and collet members being provided intermediate said plurality of collet actuator members and having slot profiles for landing engagement with said internal indicating profiles.

22. Apparatus for treating a subterranean formation intersected by a well casing that is perforated at a plurality of subsurface zones, comprising:

a service/completion liner assembly having a plurality of interconnected packer and indicating extension tools for sealing within the well casing and isolating each of said plurality of subsurface zones and defining a plurality of isolated casing annulus zones within the well casing, said service/completion liner assembly defining a service tool passage;

said interconnected packer and extension tools each having a sleeve valve body defining fluid injection ports and a sliding sleeve valve being moveable within said sleeve valve body and defining injection ports and being moveable to an open position with said injection ports in registry and a closed position with said injection ports blocked and preventing fluid flow;

each of said packer/indicating extension tools having a downhole convertible indicating collar mechanism defining an internal indicating profile;

a converting mechanism within each of said downhole convertible indicating collar mechanisms having a traveling sleeve member being moveable to positions establishing a "Go" condition preventing the landing of well treatment tools on said indicating profile and a "No-go" condition exposing said internal indicating profile for landing of well treatment tools thereon; and a well service tool adapted for conveyance into and through said service tool passage and having an actuator collet adapted for selective movement of said sliding sleeve valve to said open and closed positions thereof and for converting actuation of said traveling sleeve member of said downhole convertible indicating collar assembly to said "Go" condition and said "No-go" condition.

23. The apparatus of claim 22, comprising:

a latch member releasably latching said sliding sleeve valve assembly at said open and closed positions thereof and being releasable from latching condition upon application of predetermined linear force thereto by said well service tool and an actuating collet being mounted to said well service tool and selectively actuating said sliding sleeve valve assembly to said open and closed positions thereof.

24. The apparatus of claim 23, comprising:

a traveling sleeve being moveable within said indicating collar assembly to a "go" position preventing landing of said service tool on said internal indicating profile and a "no go" position exposing said internal indicating profile for service tool landing thereon; and said actuating collet selectively establishing actuating engagement with said sliding sleeve valve assembly and said traveling sleeve for actuation movement thereof.

25. The apparatus of claim 22, comprising:

said sliding sleeve valve assembly having a tubular valve housing defining said injection ports and defining internal spaced latch recesses;

a sliding sleeve valve element being moveable within said tubular valve housing to an open position permitting fluid flow through said injection ports and a closed position blocking flow through said injection ports; and a latch member being mounted to said sliding sleeve valve element and establishing releasable retaining engagement with respective latch recesses at said open and closed positions of said sliding sleeve valve element, said latch member releasing from a respective latch recess upon application of predetermined valve releasing force thereto by said well service tool.

26. The apparatus of claim 22, wherein said downhole convertible indicating collar assembly comprising:

a tubular indicating collar defining an internal indicating profile;

a traveling sleeve being moveable within said tubular indicating collar to positions establishing said "Go" and "No-go" conditions; and at least one sleeve control member projecting within said tubular indicating collar and having condition controlling engagement with said traveling sleeve; and at least one actuating profile being defined within said traveling sleeve and being releasably engaged for movement control by said well service tool, said well service tool being selectively cycled by said well service tool to cycle said traveling sleeve to said "Go" and "no-go" conditions thereof.

27. The apparatus of claim 26, comprising:

an annular internal receptacle being defined by said indicating collar; and an annular traveling sleeve control element being located within said annular internal receptacle and supporting at least one control pin within said J-slot and controlling rotary and linear motion of said traveling sleeve to said "Go" and "no-go" conditions thereof.

28. The apparatus of claim 22, comprising:

said well service tool being of sufficient length to extend substantially the length of said service completion liner assembly and having an upper packer element and an isolation wash pipe;

a well service mechanism being mounted to said isolation wash pipe and having an isolation seal assembly for selective sealing at desired locations within said service completion liner assembly, said well treatment tool further having a set down indicating collar defining a tool indicating profile;

an annular internal receptacle being defined within said set down indicating collar;

a traveling sleeve control element being located within said annular internal receptacle and having at least one control projection thereon; and said converting actuator being a traveling sleeve member having an external J-slot within which said control projection is received and which controls rotational and linear positioning movement of said traveling sleeve member to a "Go" position permitting landing of said well service tool on said internal indicating profile and to a "No-go" position preventing landing of said well service tool on said internal indicating profile.

29. The apparatus of claim 22, comprising:

said traveling sleeve member defining an annular internal sleeve actuation profile; and an actuating and landing collet assembly being supported by said well treatment tool and having a plurality of collet members each defining a slot profile for cycling engagement with said annular internal sleeve actuation profile and for landing engagement with said internal indicating profile.

30. The apparatus of claim 29, wherein said actuating and landing collet assembly comprising:

a tubular collet support member being mounted to said well treatment tool;

said plurality of collet actuator members each being of elongate generally curved configuration and having spring-like characteristics and having a first end thereof disposed in substantially immoveable relation with said tubular collet support member and a second end thereof being disposed in moveable relation with said tubular collet support member, said plurality of collet actuator members being radially expandable and collapsible responsive to engagement with internal surfaces of said packer/indicating extension tools during movement of said well service tool therein; and collet members being provided intermediate said plurality of collet actuator members and having slot profiles for landing engagement with said internal indicating profiles.

* * * * *